US008960275B1

(12) United States Patent
Moon

(10) Patent No.: US 8,960,275 B1
(45) Date of Patent: Feb. 24, 2015

(54) PITLESS WELL ADAPTOR WITH HIGH-EFFICIENCY FLOW DIVIDER

(75) Inventor: Thomas A. Moon, Evansville, WI (US)

(73) Assignee: Baker Manufacturing Company, LLC, Evansville, WI (US)

( * ) Notice: Subject to any disclaimer, the term of this patent is extended or adjusted under 35 U.S.C. 154(b) by 501 days.

(21) Appl. No.: 13/194,327

(22) Filed: Jul. 29, 2011

(51) Int. Cl.
*E21B 33/00* (2006.01)
*E21B 43/00* (2006.01)

(52) U.S. Cl.
USPC ..... 166/85.2; 166/68; 137/561 A

(58) Field of Classification Search
USPC ..... 166/68, 85.2, 88.1, 107; 137/561 A
See application file for complete search history.

(56) References Cited

U.S. PATENT DOCUMENTS 3,482,522 A 12/1969 Baker et al.
4,023,699 A 5/1977 Lien
4,037,654 A 7/1977 Lien
4,299,553 A * 11/1981 Swaroop ..... 425/572
4,413,935 A * 11/1983 Smith et al. ..... 406/181
4,940,087 A 7/1990 Lien et al.
5,439,052 A * 8/1995 Skinner ..... 166/85.2
5,669,442 A 9/1997 Gibson
5,944,261 A * 8/1999 Heaslip et al. ..... 239/553.5
6,576,029 B2 * 6/2003 West ..... 55/349
2009/0178720 A1 * 7/2009 Torres ..... 137/561 A
2013/0167954 A1 * 7/2013 Bailey et al. ..... 137/561 A

* cited by examiner

*Primary Examiner* — Giovanna Wright
(74) *Attorney, Agent, or Firm* — Boardman & Clark LLP

(57) ABSTRACT

In various exemplary embodiments, the present disclosure relates to a flow divider in a spool for a pitless adaptor included in a booster station and/or well construction. The flow divider has a generally triangular shaped cross-section that efficiently helps direct water flow from a vertical to a horizontal direction reducing pressure head lost in the spool and thereby increasing the energy efficiency of the system. In various exemplary embodiments, the flow divider may have a variety of cross-sectionals shapes and sizes depending on the size and requirements of the well or booster station.

15 Claims, 4 Drawing Sheets

PITLESS WELL ADAPTOR WITH HIGH-EFFICIENCY FLOW DIVIDER

BACKGROUND

1. Field of the Invention

This invention pertains generally to pitless well construction, and more particularly to pitless adapter apparatus for providing a sealed connection between a well drop pipe and a delivery pipe through an opening in the well casing.

2. Related Art

A typical form of well, or booster station, construction employs a tubular well casing that extends vertically downward from the surface of the earth. Lateral distribution from the well may be provided by an underground line below the frost level for the particular area. A spool, also known as a pitless adaptor, provides a connecting device between the well casing and the surface, provides seals for the line from the well to the lateral distribution line, and provides the sealed joint for the pump actuator or the pump motor electric lines.

In pitless well construction, the well drop pipe which supports the pump at the bottom thereof is connected through a coupling or adaptor to a generally horizontally disposed delivery pipe which delivers the well tally disposed delivery pipe which delivers the well water to its point of use. The delivery pipe is generally connected and sealed to the well casing, and the drop pipe is coupled by various types of apparatus to the well casing to be in communication with the delivery pipe. Because of the limited working space within the well casing, various pitless coupling apparatus have been developed wherein a first coupling member is inserted into the opening in the well casing and is rigidly mounted thereto, with the delivery pipe being attached to this first coupling member. A second coupling member, which is attached to the well drop pipe to receive water therefrom, is then passed down into the well casing to slip onto the first coupling member until the two coupling members have their interior bores in communication such that water may be passed therethrough. Because the two coupling members in such coupling schemes are not threaded to each other, a possibility of leakage is presented at the joint between the two coupling members. The releasable fitting between the two coupling members sometimes allows for play in the joint between the members when a pressure moment is applied to the joint. Such moments result from pressure heads within the pressurized well system, are sometimes increased by the turning on off of the pump at the end of the drop pipe, with consequent leakage of water under pressure around the joint and eventual accelerated deterioration of the seal at the joints.

Generally, it is desirable that the coupling member to which the drop pipe is attached be readily removable from the well casing to allow servicing of the coupling and of the drop pipe and pump. In addition, the adapter couplings must be capable of supporting the weight of the pump and drop pipe, and of supporting such weight structurally over a period of time while subject to vibrations and pressure moment stresses.

Examples of pitless adaptors include U.S. Pat. No. 3,482,522 to Fletcher et al.; U.S. Pat. No. 4,037,654 to Lien; U.S. Pat. No. 4,940,087 to Lien et al.; and U.S. Pat. No. 5,669,442 to Gibson, each of which is incorporated herein by reference in its entirety.

SUMMARY

An exemplary embodiment relates to a pitless adapter, comprising a spool comprising at least one inlet, at least one outlet, and a flow divider comprising a generally arched profile at the top of the spool and a submersible pump in fluid communication with the spool inlet.

Another exemplary embodiment relates to a spool for a pitless adapter, comprising at least one inlet, at least one outlet, and a flow divider comprising a generally arched profile at the top of the spool.

Another exemplary embodiment relates to a well construction, comprising a vertical well casing; a spool being insertable into the wall casing, comprising at least one inlet, at least one outlet, and a flow divider; and a submersible pump with an outlet in fluid communication with the spool inlet.

These and other features and advantages of various embodiments of systems and methods according to this invention are described in, or are apparent from, the following detailed description of various exemplary embodiments of various devices, structures, and/or methods according to this invention.

BRIEF DESCRIPTION OF THE DRAWINGS

Various exemplary embodiments of the systems and methods according to the present disclosure will be described in detail, with reference to the following figures, wherein.

It should be understood that the drawings are not necessarily to scale. In certain instances, details that are not necessary to the understanding of the invention or render other details difficult to perceive may have been omitted. It should be understood, of course, that the invention is not necessarily limited to the particular embodiments illustrated herein.

DETAILED DESCRIPTION OF THE PREFERRED EMBODIMENTS

A conventional spool has a single water inlet on the bottom to receive water from the well pump and two outlets on opposite sides. The interior of the spool is generally conical with the inlet at the bottom and a flat top. The flow of water into the spool impacts the top of the spool and is diverted thereby to the sides where the outlets are located. This flow pattern results in considerable loss of pressure head from the well pump, which requires the pump(s) to do extra work to provide adequate pressure further down in the system. The present disclosure increases the efficiency of wells and booster stations by providing a spool with a high efficiency flow divider to significantly reduce pressure head lost in the spool as the water flow changes from vertical flow to horizontal flow without sacrificing the spool's critical function in allowing access to the well and pump.

Figure 1:
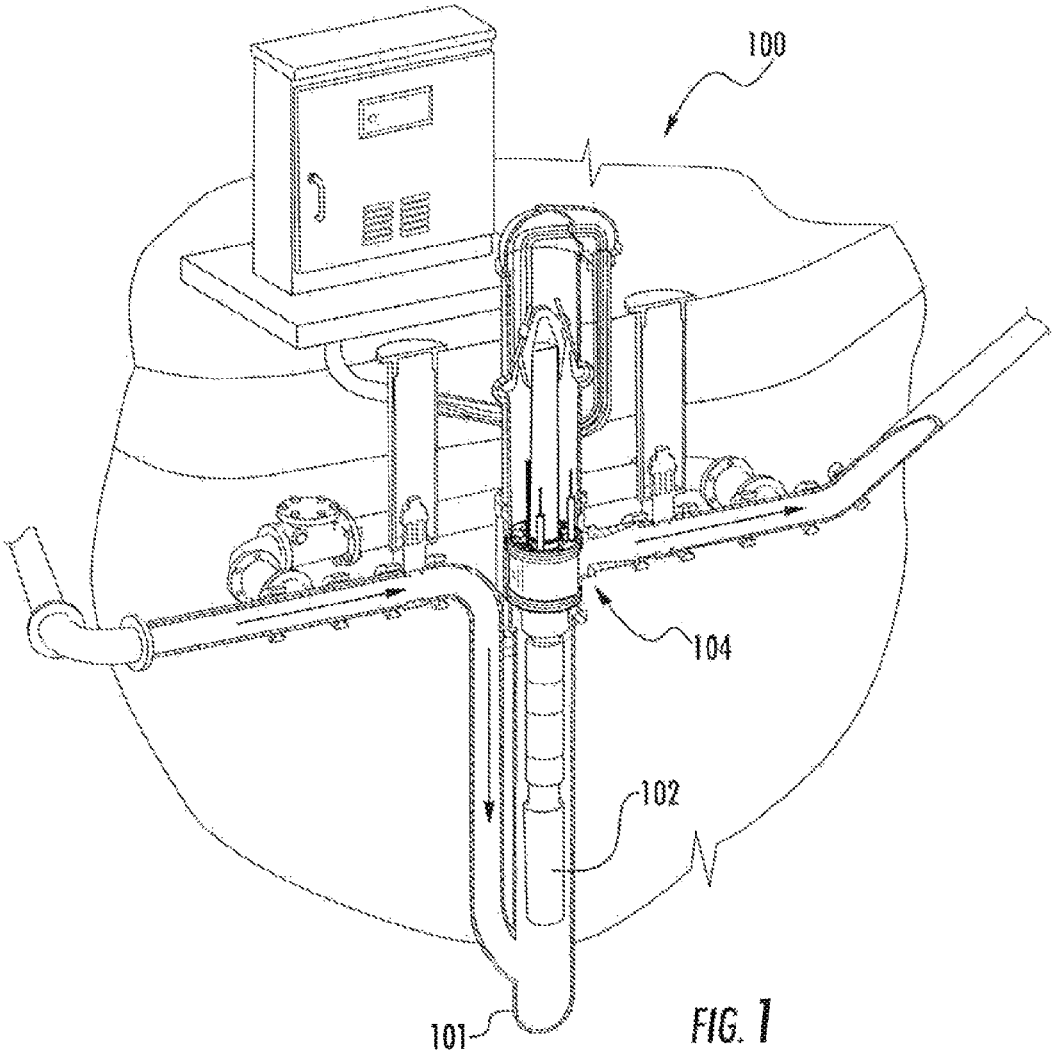
FIG. 1 is a partial cutout perspective view of an exemplary embodiment of a pitless well adapter booster station according to the present disclosure.
Figure 2:
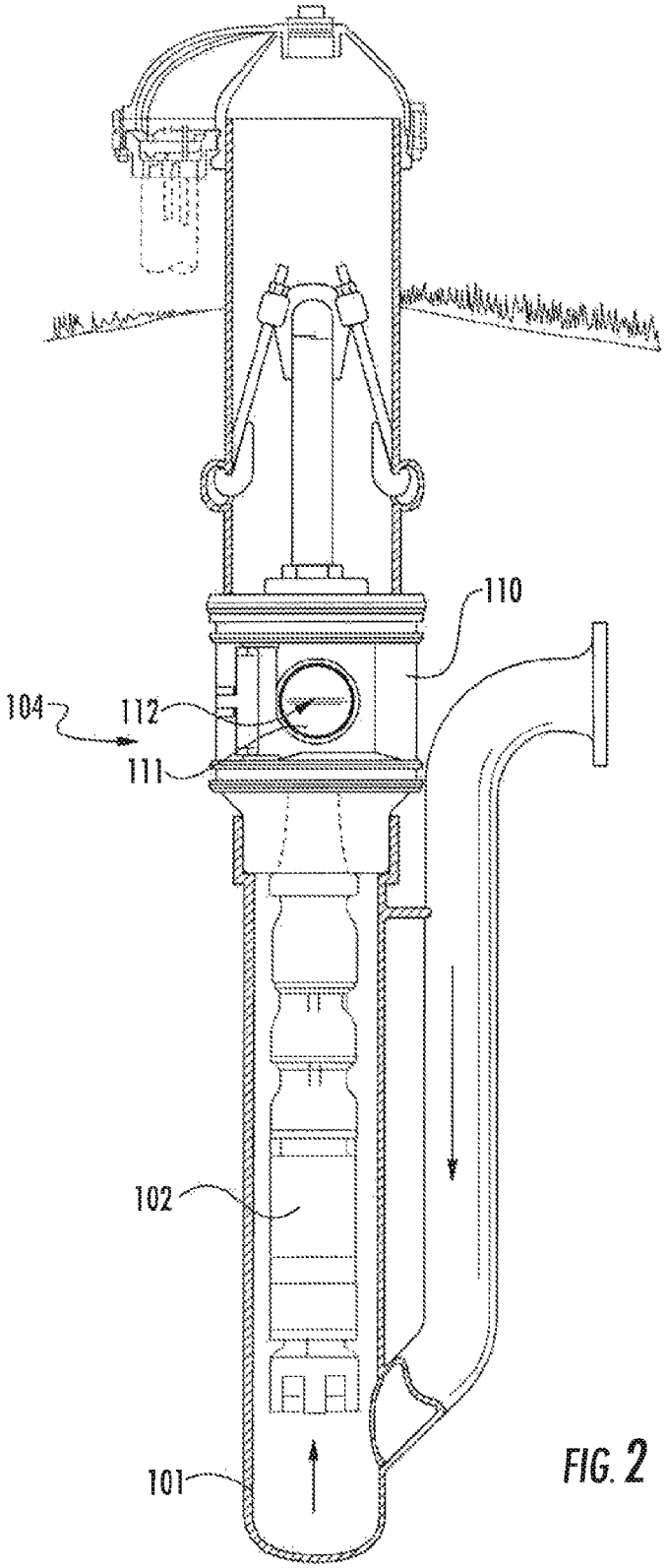
FIG. 2 is a partial side cross-sectional view of the pitless well adapter booster station of FIG. 1.
Figure 3:
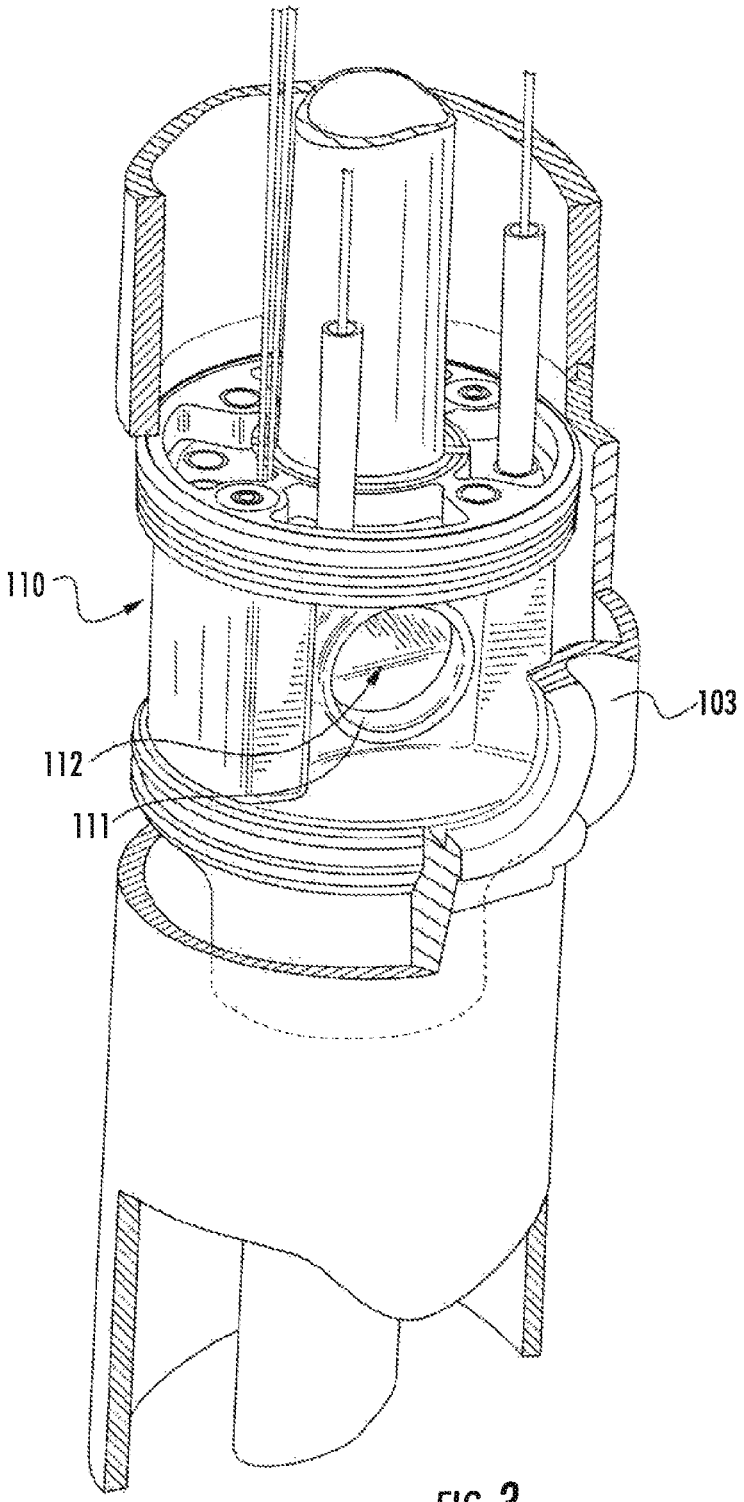
FIG. 3 is a perspective view of an exemplary embodiment of a spool or discharger body according to the present disclosure.

In particular reference to the drawings, like numerals refer to like parts throughout the several views. FIG. 1 shows a pitless adaptor booster station 100 in an exemplary water distribution system. Water from a source (e.g., a water tower) loses pressure as it passes down the system. The low pressure water is dropped into a well 101 at the bottom of the booster station 100 containing submersible pump 102. FIG. 2 shows a cross-section of a pitless adaptor 104. Submersible pump 102 pumps the water up the well 101 into the spool 110. FIG. 3 shows a portion of the spool 110. The pressurized water exits through spool outlets 111 into the discharge body 103 and continues downstream along the system. Although the pitless adaptor 104 is shown as a booster station, it should be noted that the present disclosure is not limited to booster stations and can be incorporated wherever an underground pump is used (e.g., wells or pumping stations).

Figure 4:
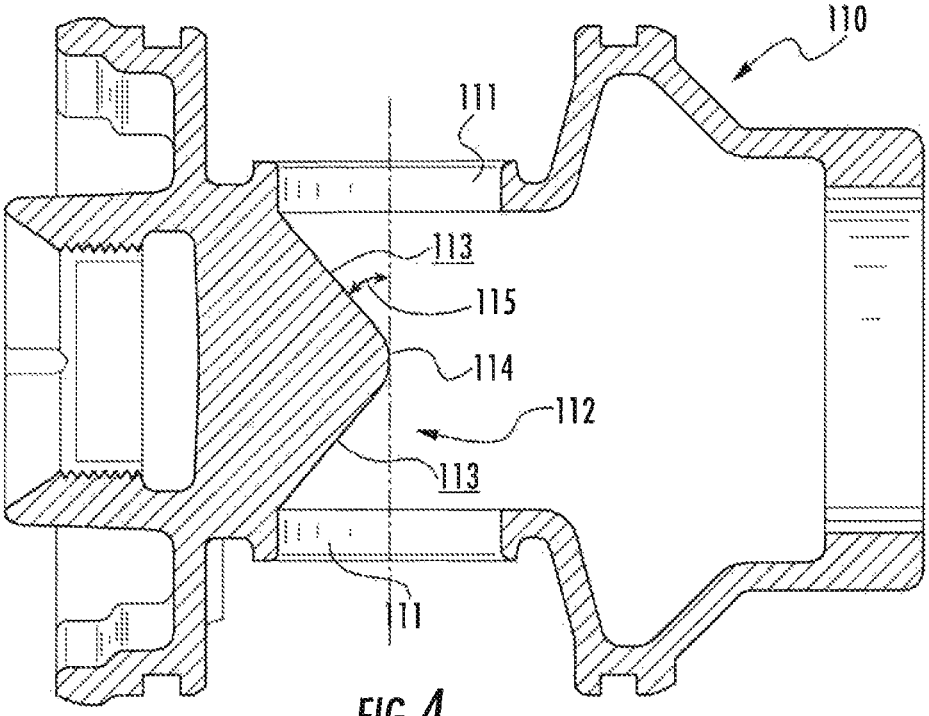
FIG. 4 is a front cross-sectional view of the spool of FIG. 3.
Figure 5:
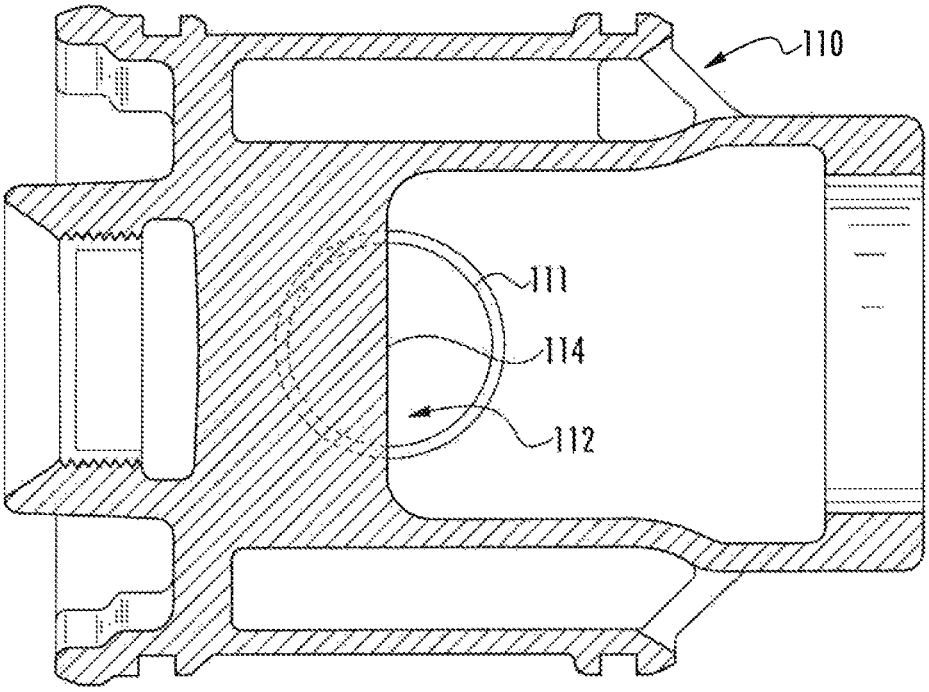
FIG. 5 is a side cross-sectional view of the spool of FIG. 3.

FIGS. 4 and 5 show the interior of a novel spool 110 and flow divider 112 according to the present disclosure. In various exemplary embodiments, as shown in FIG. 4, the flow divider 112 has a generally triangular prism shape with two faces 113 that direct water flow toward outlets 111 (the third face and the ends are not exposed). In the embodiment of FIGS. 4 and 5, faces 113 are generally flat and the tip 114 of the flow divider 112 is rounded. As used in the present disclosure and claims, the term "generally triangular prism" includes shapes wherein the exposed faces 113 are flat, concave, and/or convex and wherein the tip 114 is not straight and/or level. It should be noted that although the flow divider 112 is shown with two faces 113, the flow divider may have a single face 113 (e.g., a cone) or more than two faces 113 (e.g., a triangle-based or square-based pyramid).

In various other exemplary embodiments, faces 113 may be any combination of flat, convex, and/or concave within the scope of the present disclosure and Claims. In various other exemplary embodiments, the tip 114 of the flow divider 112 may be rounded with various radii of curvature or may be sharply pointed. In various exemplary embodiments, such as shown in FIGS. 4 and 5, the flow divider 112 may have a constant cross-sectional shape. In various other exemplary embodiments, the width and or height of the flow divider may vary along its length (e.g., be shorter in the middle or be narrower in the middle with a curved face).

In various exemplary embodiments, as shown in FIGS. 4 and 5, the faces 113 of the flow divider are at an inclined angle 115 of about 41° from horizontal (e.g., the angle between the surface of a flat face 113, regardless of face shape, and a horizontal line intersecting tip 114). In various other exemplary embodiments, angle 115 may be higher or lower (e.g., the tip may be positioned further up or down the spool). The chosen angle 115 may be chosen based on criteria including, but not limited to, system flow rate requirement, available space in the spool, the shape or curvature of the faces. In various exemplary embodiments, the angle 115 may range from about 15° to about 70°, preferably ranges from about 35° to about 50°, and more preferably ranges from about 40° to about 45°.

It should be noted that although spool 110 is shown with two essentially identical outlets 111 oppositely disposed of one another, the number and arrangement of outlets may be varied within the spirit and scope of the present disclosure and claims. In various exemplary embodiments, with a different number of outlets 111, the shape of the flow divider 112 may also be varied to more efficiently divide the flow and direct it to the outlets 111 (e.g., in a spool 110 with three outlets 111, the flow divider 112 may have a triangular base pyramid shape with a face 113 directing flow to each outlet 111). It should be noted that although the booster station 100 is shown as having a single incoming flow and a single outgoing flow, there may be any number of inlet flows. The disclosed system may also be used in applications that are not supplied with an artificial water source, such as a well.

Applicant believes that the spool of the present disclosure will achieve a marked improvement in flow dynamics through the system by reducing the pressure lost as the flow of water is turned from a vertical flow to a horizontal flow. This in turn will reduce the power consumption of the submersible pump and/or reduce the number of booster stations required to deliver the water to its destination, reducing overall electrical power consumption and the emissions associated with electrical power generation.

As utilized herein, the terms "approximately," "about," "substantially," "generally," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that references to relative positions (e.g., "top" and "bottom") in this description are merely used to identify various elements as are oriented in the figures. It should be recognized that the orientation of particular components may vary greatly depending on the application in which they are used.

For the purpose of this disclosure, the terms "couple," "attach," "connect," and the like, in their various forms, mean the joining of two members directly or indirectly to one another. Such joining may be stationary in nature or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It should be appreciated that the construction and arrangement of the flow divider, as shown in the various exemplary embodiments, is illustrative only. While the flow divider, according to this invention, has been described in conjunction with the exemplary embodiments outlined above, various alternatives, modifications, variations, improvements, and/or substantial equivalents, whether known or that are or may be presently unforeseen, may become apparent. Accordingly, the exemplary embodiments of the flow divider, according to this invention, as set forth above, are intended to be illustrative, not limiting. Various changes may be made without departing from the spirit and scope of the disclosure. Therefore, the description provided above is intended to embrace all known or later-developed alternatives, modifications, variations, improvements, and/or substantial equivalents.

What is claimed is:

1. A pitless adapter, comprising:

a discharge body defining a chamber having at least one outlet;

a spool having a body defining a chamber, comprising:

at least one inlet to the spool chamber;

at least one outlet from the spool chamber; and a flow divider with a generally triangular prism shape and having at least one face in the spool chamber; and wherein the spool chamber outlet is in fluid communication with the discharge body chamber; and a submersible pump coupled to the spool and in fluid communication with the spool chamber inlet.

2. The pitless adapter of claim 1, wherein the at least one flow divider face is generally flat.

3. The pitless adapter of claim 1, wherein:

a face of the flow divider forms an inclined angle with an imaginary horizontal line; and the inclined angle is from about 15 degrees to about 70 degrees.

4. The pitless adapter of claim 3, wherein the inclined angle is from about 35 degrees to about 50 degrees.

5. The pitless adapter of claim 4, wherein the inclined angle is from about 40 degrees to about 45 degrees.

6. The pitless adapter of claim 1, wherein the flow divider has two faces and a tip between the faces.

7. The pitless adapter of claim 6, wherein at least two spool chamber outlets are located on a side of the spool body proximate to the top of the spool; and wherein the tip of the flow divider is approximately equidistant from the spool chamber outlets.

8. The pitless adapter of claim 1, wherein:

the spool body further comprises:

a spool chamber top portion with at least a part of such top portion being at least partly defined by the generally triangular prism shape of the flow divider;

a one of the at least one inlet to the pool chamber is located at a lower end of the spool;

at least two chamber outlets are located on a side of the spool proximate to the top of the spool;

wherein the flow divider has two faces, each face addressing a spool chamber outlet;

the spool is coupled to the discharge body such that at least a portion of the spool is within the discharge body including the two chamber outlets; and the submersible pump is suspended below the spool.

9. A well construction, comprising:

a vertical well casing;

a discharge body defining a chamber having at least one outlet coupled to and located within the well casing;

a spool being insertable into the well casing, comprising:

a body defining a chamber;

one chamber inlet located at a lower end of the spool;

two generally oppositely disposed chamber outlets located on a side of the spool proximate to the top of the spool; and a flow divider having at least one face within the chamber and having a generally triangular prism shape;

wherein the flow divider has two faces, each face addressing a spool chamber outlet;

the spool is coupled to the discharge body such that at least a portion of the spool is within the discharge body including the two chamber outlets; and a submersible pump suspended below the spool with an outlet in fluid communication with the spool inlet.

10. The well construction of claim 9, wherein the wherein the at least one flow divider face is generally flat.

11. The well construction of claim 9, wherein:

a face of the flow dividing forms an inclined angle with an imaginary horizontal line; and the inclined angle is from about 15 degrees to about 70 degrees.

12. The well construction of claim 11, wherein the inclined angle is from about 35 degrees to about 50 degrees.

13. The well construction of claim 12, wherein the inclined angle is from about 40 degrees to about 45 degrees.

14. The well construction of claim 9, wherein the flow divider has two faces.

15. The well construction of claim 9, wherein the tip of the flow divider is approximately equidistant from the outlets.

* * * * *